United States Patent [19]

Gottschalk

[11] 4,166,438

[45] Sep. 4, 1979

[54] MACHINE WITH RECIPROCATING PISTONS AND ROTATING PISTON CARRIER

[76] Inventor: Eldon W. Gottschalk, P.O. Box 294, Port Hueneme, Calif. 93041

[21] Appl. No.: 741,063

[22] Filed: Nov. 11, 1976

[51] Int. Cl.[2] ..... F02B 57/00; F01B 13/04; F04B 19/02

[52] U.S. Cl. ..... 123/43 R; 123/44 D; 91/197; 417/462

[58] Field of Search ..... 91/197; 123/43 R, 44 D, 123/44 R; 417/462, 463

[56] References Cited

U.S. PATENT DOCUMENTS

| | | | |
|---|---|---|---|
| 688,591 | 12/1901 | Cary | 91/197 |
| 1,341,328 | 5/1920 | Lamplough | 91/197 |
| 3,139,871 | 7/1964 | Larpent | 123/43 R |
| 3,292,603 | 12/1966 | Wayto | 123/44 D |
| 3,810,721 | 5/1974 | Eyer | 91/197 |
| 4,077,365 | 3/1978 | Schlueter | 123/43 R |

FOREIGN PATENT DOCUMENTS

| | | | |
|---|---|---|---|
| 652883 | 11/1937 | Fed. Rep. of Germany | 123/44 D |
| 376317 | 5/1964 | Switzerland | 123/44 R |

*Primary Examiner*—John J. Vrablik

*Attorney, Agent, or Firm*—Wm. Jacquet Gribble

[57] ABSTRACT

A reciprocating piston machine useful as a pump, a hydraulic motor or an internal combustion engine has a plurality of cylinders in a carrier surrounding a central shaft. The carrier is in turn surrounded by a ported manifold. The carrier and manifold are adapted for relative rotation one to another such that the cylinders periodically open to the ported manifold. Pistons within the cylinders each describe a path in the carrier tangent to a circle in the plane of rotation of the carrier. A gear fixed to the manifold housing about the central shaft induces relative motion between the manifold and the carrier by linkage including gears and shafts and connecting rods of the pistons.

In the motor and pump mode, the machine is valveless, and in the engine mode a single valve per cylinder completes the valving functions necessary for an internal combustion engine. A valving cam fixed to the manifold housing biases valving lever arms as relative motion between the manifold housing and the carrier is accomplished.

Depending upon the mode, the apparatus of the invention includes manifold ports for pump input and exhaust, hydraulic motor power input and return, and engine input and combustion products exhaust.

1 Claim, 16 Drawing Figures

8
8
14
14
112
113
111
115
116
139
118
138
114
123
274
255B
137
271
17A
44
110
245
62
140
61
130
131
63
17
215
46
120
168
167
212
211
133
134
135
216
217
218
121
120A
255
252
251
120
255C
113
255A
254
255B
253
139
274
114
255B

2 CYLINDER
4x1 GEARING

MACHINE WITH RECIPROCATING PISTONS AND ROTATING PISTON CARRIER

BACKGROUND OF THE INVENTION

The invention relates to machines for performing work involving compression and exhaust functions and adapts to pumps, hydraulic motors, and internal combustion engines. The inventive apparatus in the pump mode has the advantages of a piston pump in high pressure capacity but has the smoothness of output associated with centrifugal pumps. As a pump or as a hydraulic motor, which except for point of energy application operate identically, the valvelessness of the inventive apparatus increases mechanical efficiency by reducing the weight of moving parts and reduces overall weight as well as removing requirement for valve timing pulse, thereby increasing volumetric efficiency.

Internal combusion engines, both of the conventional reciprocating type and rotary type such as the Wankel design have inherent disabilities. The reciprocating engine requires a flywheel to smooth the power delivery to the work. However, the flywheel weight is an inefficiency in the engine. Also, the reversal of the piston travel both at top and bottom of its reciprocating strokes requires the overcoming of inertia since the piston in effect reaches rest at both extremes of travel. These inertia problems are overcome by the rotary type engines but inherent in the rotary design is a problem with sealing against the pressures of combustion and compression due to the substitution of line sealing for the surface sealing of a piston engine. The present invention overcomes sealing deficiency by using conventional pistons. It also overcomes the deficiencies in volumetric efficiency of conventional engines, pumps, and motors because of its unique valving arrangement.

The inventive apparatus may be used for vacuum pump, a high head pump, or for viscous liquid pumps, soft granular material pump, and may have both high pressure and sensitive valving. Because of its volumetric efficiency, its use as a pneumatic compressor enables it to be a large volume high pressure unit.

SUMMARY OF THE INVENTION

The invention contemplates, in a fluid machine having input and output ports in a housing surrounding a workshaft with means for conducting fluid to a port, the combination which comprises a carrier in the housing about the shaft and rotatable about the shaft axis and a plurality of continuous walls within the carrier each defining a chamber adapted to connect to the ports for fluid interchange therewith. A piston in each chamber is connected to a crankshaft with means linking each crankshaft to the housing to transmit force between the pistons and the housing to induce relative movement between the housing and the carrier for cyclical coincidence between the chambers and the port.

The carrier may be either fixed to the shaft or rotatable with respect to the shaft and the housing may be rotatable with respect to the carrier or vice versa depending on the purposes to be accomplished. Likewise the means for conducting the fluid through a port may be a fluid pump or may be a fluid conduit, and, if the latter, the combination may further include a prime mover coupled to the workshaft.

The means for conducting fluid to a port may comprise a fuel-injecting apparatus and a chamber valve. Preferably the manifold is an annulus within which the carrier rotates, said annulus having port openings communicating with the cylinders in the carrier, the ports in the annulus being radially spaced about the inner surface of the annulus. The invention does not preclude the ganging or linking of a plurality of carriers to a single work shaft or two or more carriers ganged to two or more work shafts synchronized through a gear box to achieve greater work output. The carriers on a single shaft may be radially staggered such that the input and output pulses of each carrier are non-coinciding to thereby increase the effective pulses per revolution of the workshaft. The gearing between the pistons and the workshaft may be such that the piston completes two cycles per revolution of the workshaft or four cycles per revolution or more depending upon the design purpose of the machine.

The invention is unique in its versatility and in its combination of elements to achieve flexibility in performance to achieve either volumetric efficiency or mechanical efficiency. Unlike conventional engines, where horsepower is proportional to the linear speed of the piston, the engine configuration disclosed is not dependent upon piston speed alone to generate high horsepower output but, by more power pulses per output shaft rotation with more power output per rotation.

The engine of the invention requires no additional power consuming flywheel; the inertia of the carrier itself serving to smooth output pulses.

In addition the engine distributes equal force to both piston and cylinder. Each reacts in an opposite direction to the force of cylinder pressure. Such reaction further impels the carrier in its rotation with respect to the housing containing the manifold. Since the reaction force on the cylinder is lost in the conventional engine in vibration and engine rock, the advantage of the present engine is enhanced. The piston travel with respect to the circle of rotation is preferably tangential so that the piston travel adds torque force in the direction of carrier rotation.

The gearing between piston crank shafts and drive shafts is basically planetary. Gearing may therefore be varied in geometric increments to achieve desired torque on the shaft.

These and other advantages of the invention are apparent from the following detailed description and drawing.

BRIEF DESCRIPTION OF THE DRAWING

In the various figures like parts are identified by like numerals.

DESCRIPTION OF THE PREFERRED EMBODIMENTS

Figure 1:
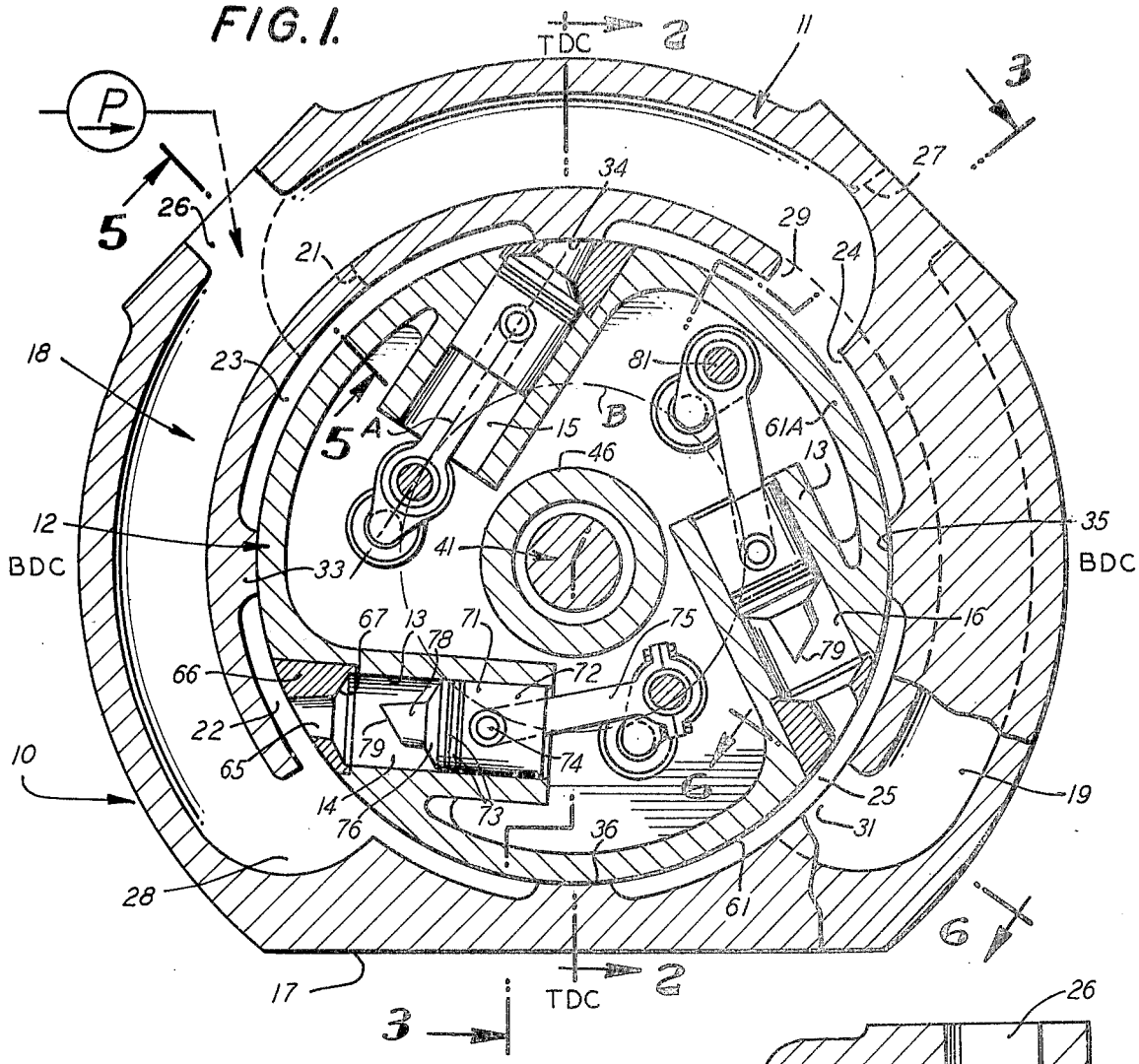
FIG. 1 is a transverse sectional elevation to a reduced scale of a machine in accordance with the invention having three cylinders in a central carrier.

For purposes of clarity, several basic definitions will be set forth here.

Machine: arrangement of parts to do work.

Pump: externally powered machine for transferring fluid from one place to another;

Motor: rotating or reciprocating device impelled by outside force such as fluid under pressure.

Engine: machine changing fuel into energy and communicating said energy in an output shaft.

PUMP-MOTOR

In accordance with these definitions the apparatus 10 of FIGS. 1 through 6 qualifies either as a pump or a motor depending on the source of energy, i.e., whether the shaft or the fluid provides impetus. As can be seen from FIG. 1, a ported manifold 11 surrounds a basically cylindrical carrier 12 having a plurality of continuous walls 13 within the carrier each of which defines a cylinder 14, 15, 16. The manifold may rest upon a base 17.

Figure 5:
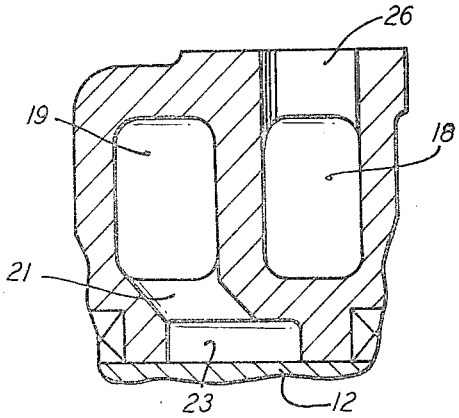
FIG. 5 is a fragmentary sectional view taken along line 5—5 of FIG. 1.
Figure 6:
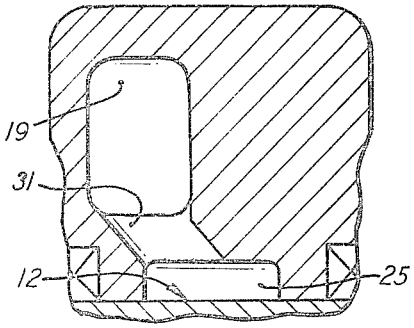
FIG. 6 is a fragmentary sectional view taken along line 6—6 of FIG. 1.
Figure 2:
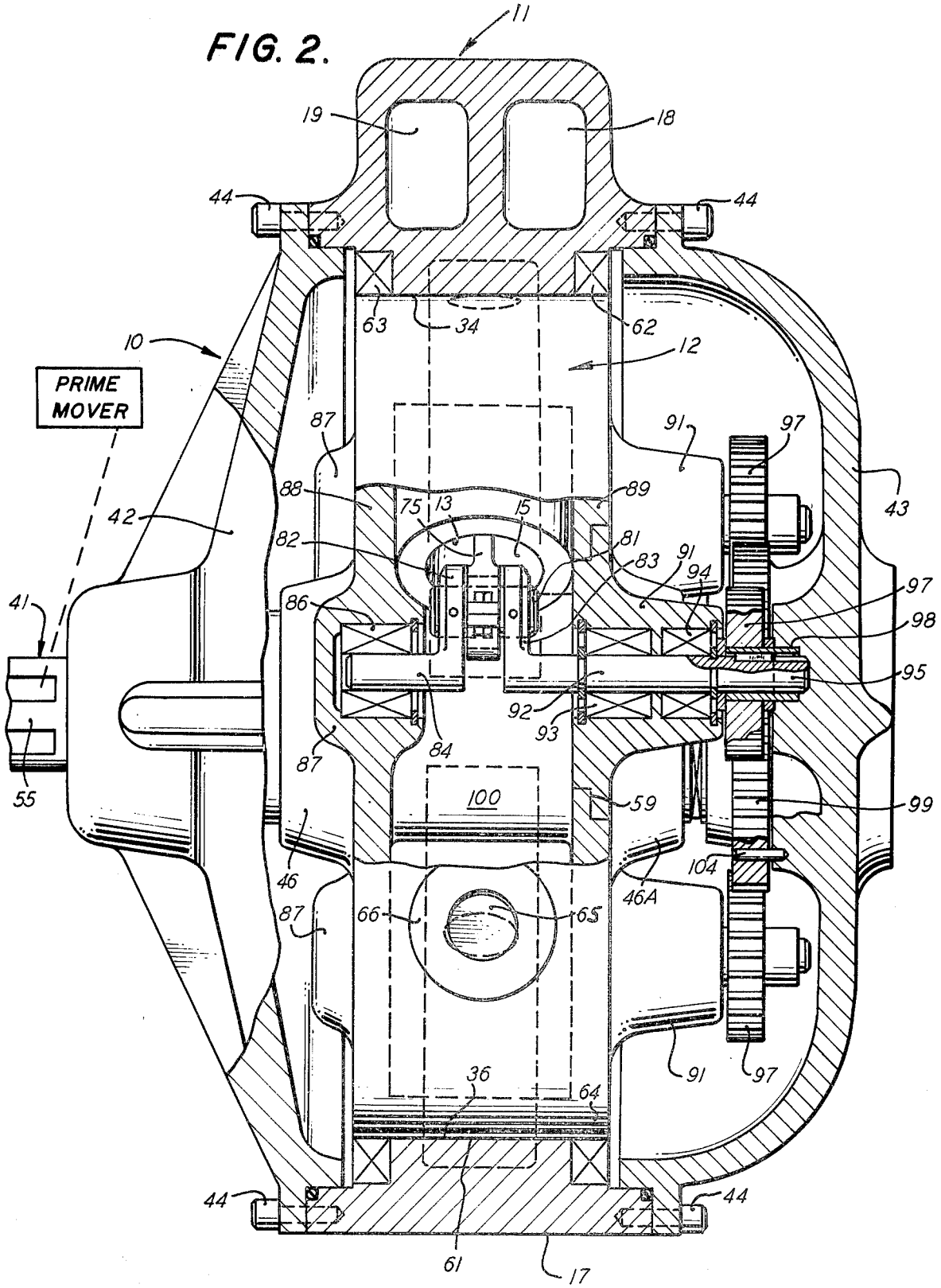
FIG. 2 is a sectional elevation to a larger scale line 2—2 of FIG. 1.
Figure 3:
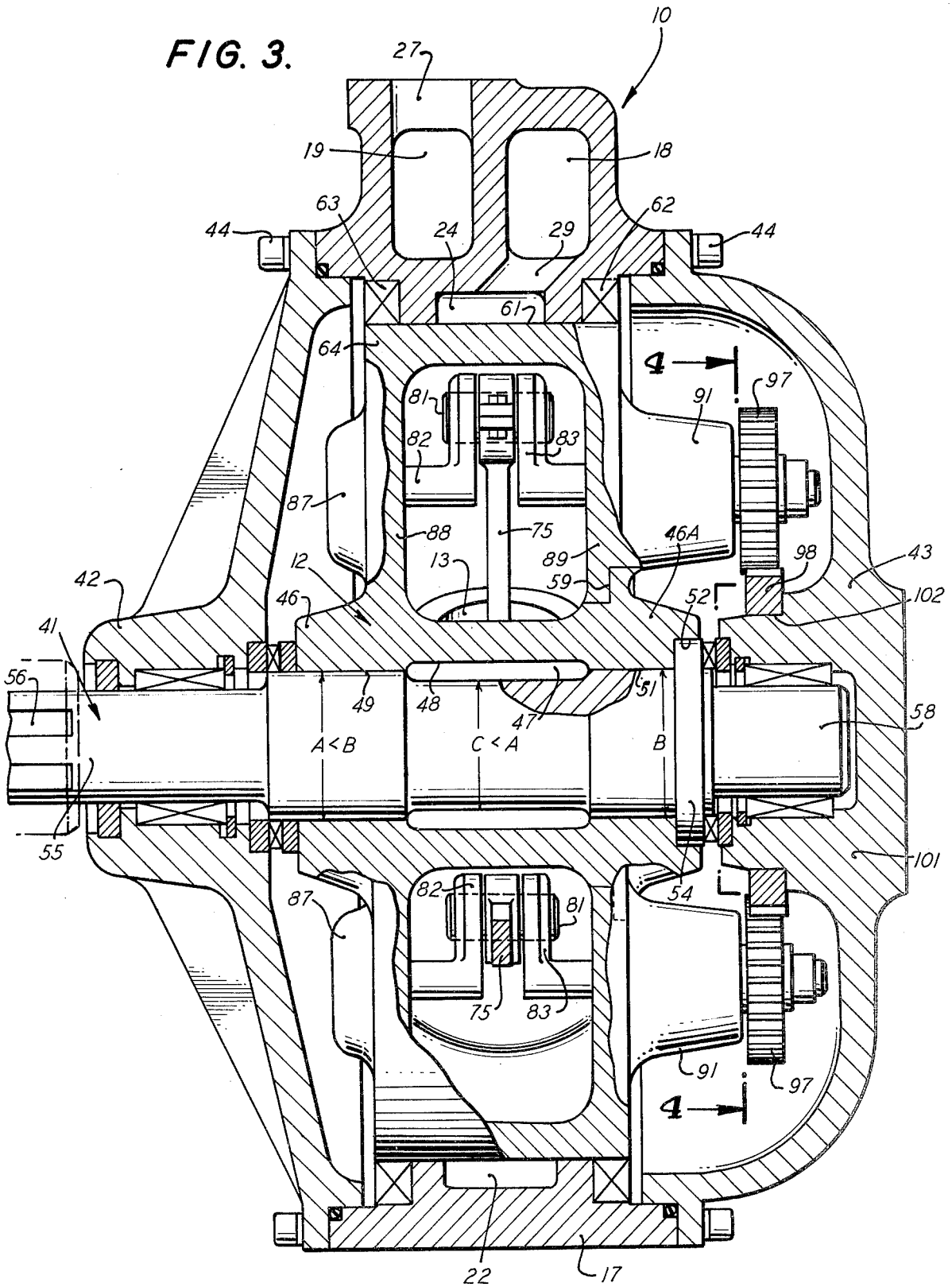
FIG. 3 is a staggered sectional elevation taken along line 3—3 of FIG. 1.

FIG. 2 shows that the manifold has two circumferential manifold chambers 18 and 19 from which a series of ports such as the port 21 of FIG. 5 communicates with radially spaced peripheral cavities 22, 23, 24, 25, of the manifold housing. Peripheral cavities 22 and 24 communicate to the exterior of the housing by way of manifold chamber 18 and external port 26 shown in FIGS. 1 and 5. Peripheral cavities 23 and 25 communicate through manifold chamber 19 to the exterior through port 27 shown in FIG. 3 and in dotted lines in FIG. 1 and in FIG. 3.

Each of the manifold peripheral cavities 22 through 25 connects to a manifold chamber by means of a port such as the port 21. For instance, port 21 connects cavity 23 to chamber 19 and thus communicates with exterior port 27 of that chamber. Cavity 22 connects to manifold chamber 18 through port 28 as does cavity 24 by means of port 29 (see FIGS. 1 and 3). Peripheral cavity 25 connects to manifold chamber 19 through a port 31 partially shown in FIG. 1 and shown in section in FIG. 6.

The manifold chambers are therefore connected to alternate peripheral cavities in the particular embodiment shown, for reasons to be discussed later.

A transverse gate extends between each of the peripheral cavities to divide them one from another. Gate 33 separates cavities 22, 23, gate 34 separates cavities 23, 24, gate 35 separates cavities 24, 25, and gate 36 separates cavities 25 and 22. Gates 34 and 36 are shown in FIG. 2 and it is evident from FIGS. 1 and 2 that the gates are at 90 degree intervals about the circumferential travel of the carrier.

In the embodiment of FIGS. 1–6, carrier 12 is fixed to a central shaft 41 which is bearing mounted in end bells 42, 43, which are secured conventionally by a plurality of bolts 44 to the manifold 11. The carrier has a central hub 46, through which a stepped bore 47 penetrates. The stepped bore has three bore sections of varying diameters with a central bore section 48 being largest and a bore section 49 being smaller than 48 and slightly smaller than a bore section 51. A counter bore 52 in hub portion 46A accepts a large stop collar 54 of shaft 41. Shaft 41 also has a reduced diameter power segment 55 which may be longitudinally grooved at 56 to accept a splined coupling. Opposite the power section of the shaft is a bearing stub 58 to which the bearings are seals of end bell 43 are mounted.

The shaft is joined with the carrier by press-fitting the shaft into the carrier by first inserting shaft section 55 into bore section 51. Since bore section 49 is slightly smaller than bore section 51 and the shaft is similarly stepped, it is only at the latter stages of mounting that there is any frictional contact between the shaft sections and the bore sections, thus obviating the problem of metallic galling. The carrier is thus fixed to the shaft by the press-fit between the shaft sections indicated by the dimensions A and B with the carrier bore sections 49 and 51 respectively. The union of collar 54 with counterbore 52 locates the shaft longitudinally of the central axis of the carrier.

The carrier is preferably divided along line 59 for convenience in making and repairing.

The bearings and seals mounting the shaft and sealing the end plates with respect to the manifold may be conventional, as shown. The cylindrical periphery 61 of the carrier is sealed by annular sealing rings 62, 63 which are shown seated in the internal periphery 64 of manifold 11, but alternatively may be seated in and carried by the carrier periphery. A surface-to-surface seal is thereby established between the rotating carrier and the static manifold. In other embodiments wherein the manifold may rotate with respect to a static carrier the same sealing arrangement is still beneficial. Rings 62,63 may be labyrinth seals.

As can be seen from FIG. 1, the area bounded by the peripheral well 61A of the carrier is essentially hollow except for the integral walls 13 which define the cylinders of the carrier. Each cylinder has a central axis A which is tangent to a circle B in the plane of rotation of the carrier (see FIG. 1). The circle is centered on the longitudinal axis of the shaft and of the carrier, which axes coincide. Each cylinder is open away from the peripheral wall of the carrier and has a restricted port 65. The port may be defined by a metallic insert 66 press-fitted or otherwise fixed into the peripheral wall of the carrier and the defining wall of the cylinder. The insert and the port preferably are concentric with the cylinder and each opens into its respective cylinder in a truncated conical cavity 67 from which the restricted port 65, which is also in the configuration of a truncated cone, extends outwardly.

Within each cylinder a piston 71 reciprocates. The piston is conventional in its basic design having a skirt 72 and rings and ring grooves at 73 and piston pins 74 to connect to a connecting rod 75 which may have a segmented bearing. However, the piston dome is uniquely shaped to achieve total evacuation of the cylinder when the piston reaches top dead center. The dome has a frustroconical top 76 matching in configuration and size the transition cavity 67 of the cylinder insert 66. Extending from top 76 is a second frustro-conical solid 78 which coincides in shape and size with the restrictive port 65 of each cylinder. The outward terminating surface 79 of the piston dome is an arcuate segment of a cylinder coinciding in radius with the radius of the carrier periphery 61. Thus, as is illustrated by the top-dead-center position of the piston within cylinder 15, the evacuation of the cylinder by the piston is substantially total. This piston configuration contributes to the volumetric efficiency of the machine of FIG. 1 as a displacement pump, which may be a vacuum pump, and is particularly useful in the latter application.

Within the cavity of the carrier in FIG. 2, a connecting rod 75 of each piston is secured to a concentric pin 81 of a divided crank which has a short axle arm 82 and a long axle arm 83. The axle 84 of arm 82 is mounted by bearings 86 in a thickened boss 87 of a carrier sidewall 88. The opposite carrier sidewall 89 supports an extending boss 91 for each of the crank arms in which the long axle 92 of crank arm 83 may be journaled as by paired bearings 93, 94. One piece crank arms may be used for high horsepower units.

An extending end 95 of axle 92 is broken away to show the mechanical arrangement for keying a metallic gear 97 to each of the crankarms exteriorly of the carrier and interiorly of the end bell. It is preferred to use a hubless gear for adjusting timing and therefore the key is shown connecting between a central metallic gear bushing 98 and the end 95 of the crankarm. The bushing may be pinned to the end after timing.

Figure 4:
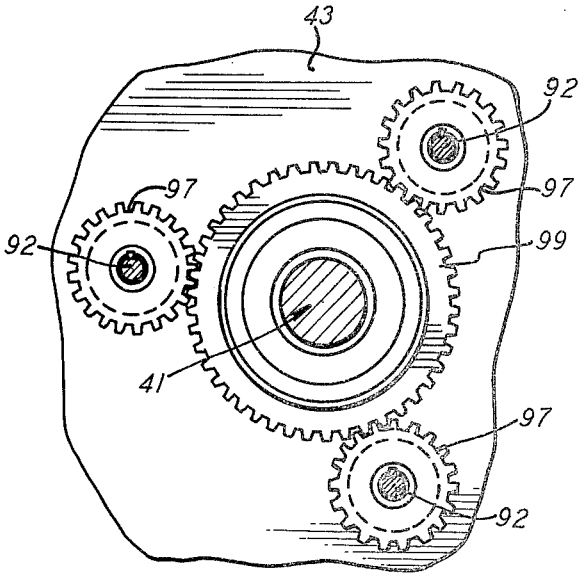
FIG. 4 is a fragmentary elevational view taken along line 4—4 of FIG. 3.

Each of the cranks of each piston 71 in FIG. 1 has a gear 97 secured thereto and all the gears engage a larger central ring timing gear 99 as shown schematically in FIG. 4. The gear may be composition to reduce noise and to absorb inherent vibration. As can be seen from FIG. 3, the central gear 99 is fixed to an internal hub 101 of end bell 43, in which hub bearing section 58 of shaft 41 is mounted. The hub is turned to fashion a mounting step 102 and timing gear 99 is secured in position on the step by a key, or by a pin 104 extending into the hub (see FIG. 2). It can thus be seen that induced motion of the pistons results in a revolution of the throw arms of the cranks, causing rotation of the gears with respect to timing gear 99, thus imposing a rotational motion on the carrier (and the shaft to which it is fixed) with respect to the surrounding manifold. Conversly, if power input is applied to shaft 41 causing rotation of the carrier with respect to the manifold, the relative movement of the crankgears carried about the timing gear induces motion of the cranks and reciprocates the pistons within the cylinders. In this latter case, the apparatus 10 of FIG. 1 is operating in the pump mode. In the previously delineated motion, apparatus 10 is operating in the motor mode.

As a motor, fluid under pressure is introduced into exterior port 26 and thence through chamber 18 and ports 28 and 29 at a continuing pressure. As each cylinder of the carrier progresses away from the valving gates 34 and 36, fluid such as an hydraulic liquid enters a port 65 as the position of the port coincides with the cavities 22 and 24 and the fluid pressure exerts a force on the piston dome causing the piston to reciprocate within the cylinder and thus, through the connecting rod, crankarm and planetary gear linkage, induce rotation of the carrier and the shaft. Section 56 of the shaft in FIG. 3 then becomes an output shaft for power.

In the described embodiment of FIG. 1, the gear ratio of the cranks to the "output" shaft 41 is 1:2 such that the pistons within the three cylinders of the carrier describe 2 cycles with each rotation of the shaft and carrier. Thus for each rotation of the shaft and carrier there are 6 power pulses. With a proper change in gearing and/or manifold, ratios other than 1:2 may be used. In the pump configuration, the same is true. There are 6 output pulses for each rotation of the carrier. In operation as a pump, liquid introduced through exterior port 26 is drawn into the cylinder by the downward stroke of the pistons 71 as the cylinders move away from gates 34 and 36 and open onto peripheral cavities 22 and 24. The pistons reach bottom dead center coincident with the closing of the restricted port 65 by either gate 33 or 35 as the carrier progresses. The restricted port 65 is sealed from intake and exhaust cavities during gate transition. Little piston movement therefore takes place during gate transition time. With the opening of the restricted port 65 after leaving gates 33 and 35 liquid within the cylinder is discharged into cavities 23 and 25 and through ports 21 and 31 into the manifold chamber 19 and thence outwardly through exterior port 27 for delivery.

Because of the number of pulses per cycle of the carrier, the power output as a motor is very smooth, with the carrier acting as a flywheel. In the pump mode, the fact that there are 6 delivery pulses per cycle of the carrier also increases the smoothness of the emerging stream. In either mode, the number of power pulses may be altered by changing the gear ratio between the crank arm gears 97 and the central ring gear 99 and altering the number of gates which close the restricted port 65 as the carrier progresses, or by changing number of cylinders in the carrier (see FIGS. 15 and 16). Not only does the pump mode of the apparatus of FIG. 1 deliver high pressure performance while approximating the smoothness of a centrifugal pump, but the physical configuration is such that the apparatus is capable of pumping a wide range of substances. The surface sealing of the pistons permits good seals and extremely small viscosity liquids may be efficiently handled. Conversely, because of the volumetric efficiency of the device, the pump may handle high viscosity substances as well. Substances of mixed viscosity may also be handled such as commonly encountered in foods, the only restriction being that the semi-solids or solids of the mixture be shearable so that solids or semi-solids do not jam when the restrictive port 65 passes the gates but are such that the edges of the gates shear the material and do not thereby interfere with the progression of the carrier past the gates.

Lubrication of the motor and pump embodiments is contemplated in two stages—both using "lifetime" lubricants suited to the particular machine usage. Note that the carrier has an inner volume 100 accessible for lubricant charging before assembly by separation at line 59. Also, the gear box defined between the carrier and end bell 43 may be charged with an oil or grease before assembly. It is also possible that a more sophisticated lubrication system such as that described and shown with respect to the embodiment of FIG. 7 may be used with the embodiments of FIGS. 1–6.

Those embodiments, as pumps, may be utilized as measuring devices similar in function to a quantitative Wheatstone bridge—where balance between input and output would measure forces—or as a fluid meter, since the carrier is displaced in direct proportion to the volume flow through the ports.

The advantages of mechanical and volumetric efficiency accruing to the benefit of the motor and pump of the invention also benefit the internal combustion engine of the invention.

THE ENGINE

Figures 7, 13, 14:
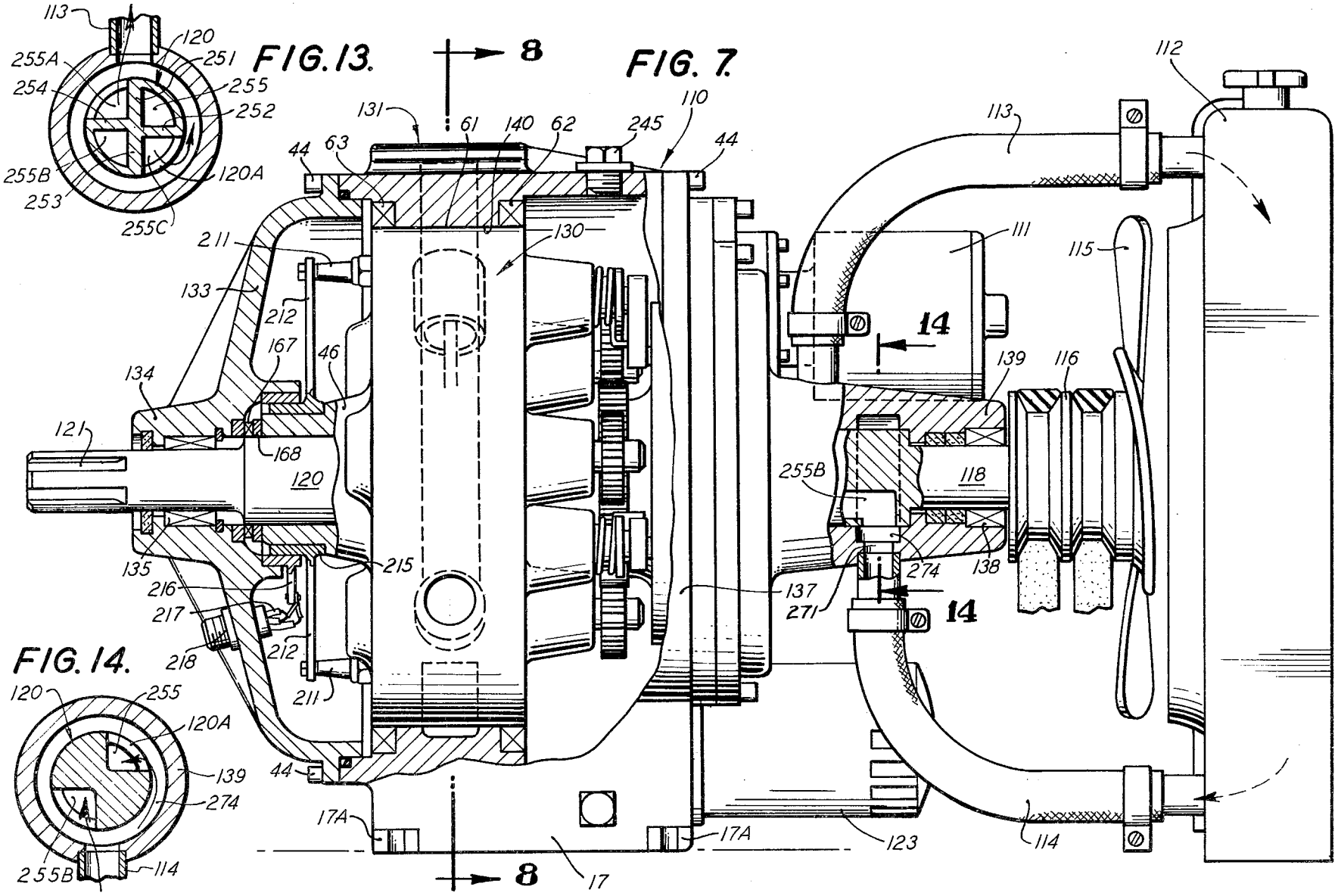
FIG. 7 is a schematic elevational view partly in section of a four-stroke engine in accordance with the invention.
FIG. 13 is a transverse sectional elevation taken along line 13—13 of FIG. 9.
FIG. 14 is a fragmentary sectional elevation taken along line 14—14 of FIG. 7.

FIGS. 7 through 14 illustrate a four stroke engine 110 shown in FIG. 7 in combination with a conventional starting motor 111 and cooling radiator 112, with attendant coolants circulated through hoses 113 and 114, hose 114 being the coolant return to the engine. A conventional cooling fan 115 with a pulley and pulley belt assembly 16 is shown on the accessory end 118 of a drive shaft 120. The splined power output end 121 of the drive shaft is opposite the radiator. The engine also utilizes a conventional lubricating oil filter 123. Other conventional engine accessories not essential to the understanding of the invention are not shown to simplify illustration.

Although the inventive concept in an engine mode is set forth herein embodied in a four cycle engine, the invention does not preclude embodiment in either 2 cycle or diesel engine configuration.

Several of the Figures show shaft 120 to be hollow for conducting cooling and lubricating liquids of the engine. The system for both cooling and lubricating is discussed in more detail at a later point.

As in the previously described embodiments, a basically cylindrical carrier 130 rotates within a surrounding manifold 131. The manifold may rest upon a base 17 with bolt-down lugs 17A provided for securing the engine to a rest. An output end bell 133, secured to manifold 131 by bolts 44, has an outboard boss 134 in which a bearing 135 journals the output end of shaft 120. At the opposite side of the carrier a second plurality of bolts 44 secures an accessory end bell 137 to the opposite side of manifold 131. Bearing 138 supports the accessory end 118 of shaft 120 in an accessory boss 139. Conventional seals are used at either end of the shaft to guard against loss of coolant and lubricant, and to serve as dust seals.

The outer periphery 61 of the carrier resides within a cylindrical chamber 140 of the surrounding manifold. Annular seals 62, 63 residing in the manifold seal the carrier and the manifold surfaces.

Figure 8:
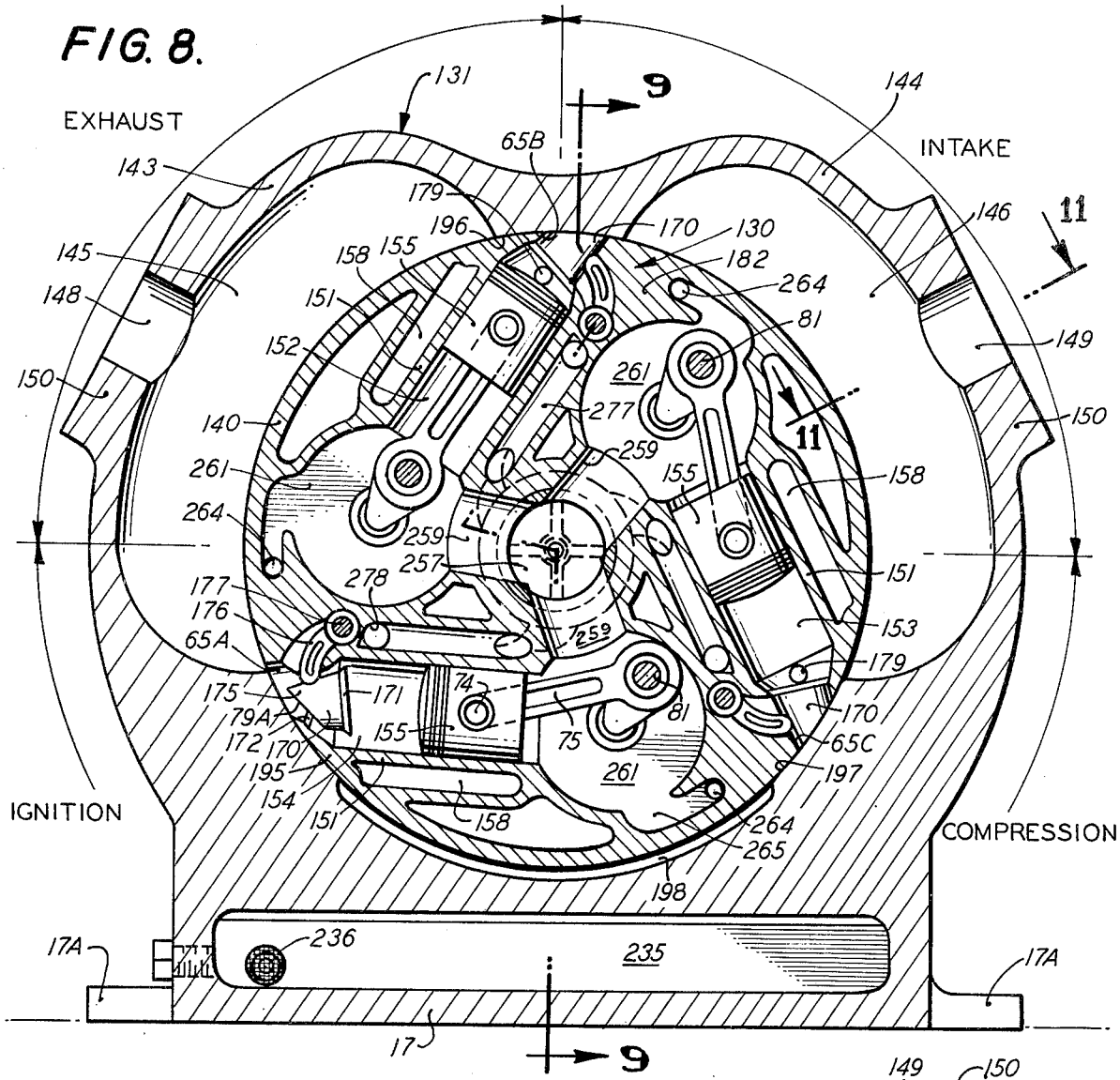
FIG. 8 is a transverse sectional view taken along line 8—8 of FIG. 7.

Turning now to FIG. 8 it can be seen that the manifold comprises an exhaust lobe 143 and an intake lobe 144, each of which lobes surrounds a manifold chamber 145 and 146 respectively. The chambers each have a transverse or axial width less than the width of the carrier. Chamber 145 has an outlet port 148 and chamber 146 has an intake port 149. Each port is surrounded exteriorly by a machined flat 150 adapted for suitable conventional gasketing and fitting of exhaust and intake accessories.

The engine carrier 130 of the embodiment of FIG. 7 is more intricate than the carriers of the previously described embodiment because of the need to cool and further lubricate the machine of the embodiment of FIG. 7, since its purpose is to convert fuel into energy to be communicated to an output shaft such as the shaft 120. In addition, engine carrier 130 must be provided with a valve for each cylinder in order to accomplish the four operating cycles of the internal combustion engine.

As in the previous embodiment, three continuous walls, such as the wall 151 seen in FIG. 8, define cylinders 152, 153, and 154 in each of which a substantially conventional ringed-piston 155 reciprocates. A cooling cavity 158 surrounds each cylinder to provide for a coolant to circulate about the cylinder. A piston pin 74 links each piston to a connecting rod 75 which is mounted on the crank of a compound piston crank having a short crank arm 82 and a long crank arm 83 in the manner described with respect to the embodiment of FIG. 1. (See FIG. 9.) Although not shown, each of the crank arm components 82, 83 is bearing-supported in opposite walls of the carrier and assembled together with the connecting rod 75 by the crank arm pin 81 in a unitary assembly supported at both ends. Since the crank arms are an essential component of the power transfer, it is preferred that the crank arm not be supported in cantilevered fashion from a single bearing mount but be supported in the manner shown at both sides of the crank arm pin. However, one piece crank arms may be used with conventional bearings.

The long axles 92 of each crank arm 83 (see FIG. 9) of the embodiment of FIG. 7 arm journaled as described in a carrier boss 91 and a protruding axle end 95 supports a gear 97 which engages a composite timing or ring gear 99 secured about an inner hub 161 of a manifold end bell 137. With the three gears 97 enmeshed with gear 99 and fixed to the crankshaft axles 95, relative motion between the carrier and the surrounding manifold results in reciprocating motion of the pistons within the cylinders, as described in respect to the previous embodiment. Conversely, the engine of FIG. 7 uses energy from fuel applied to the piston in the cylnders to rotate the carrier and the shaft to which it is fixed with the manifold, and shaft 120 becomes a power output shaft.

Figure 9:
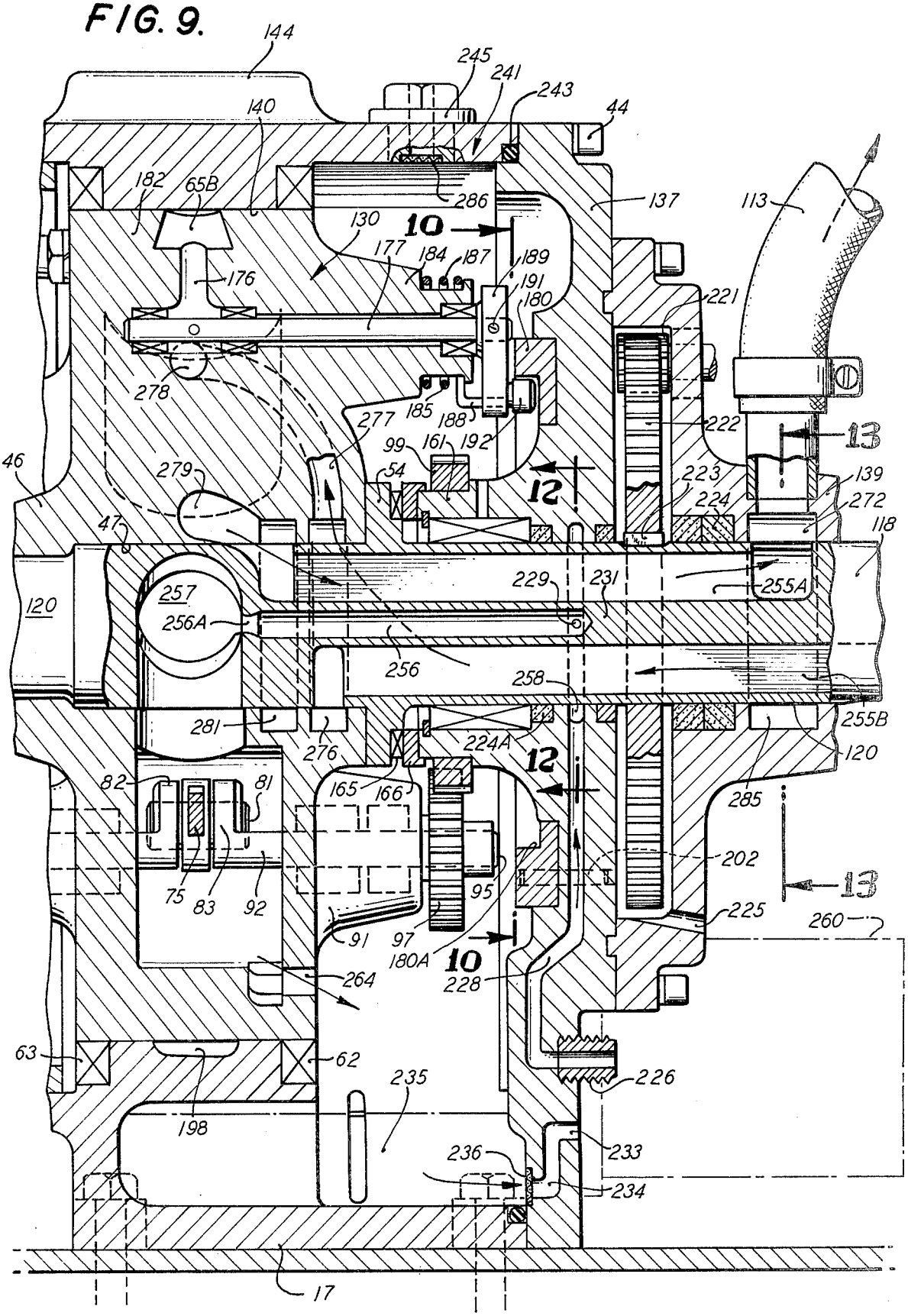
FIG. 9 is a longitudinal sectional elevation, partly broken away, taken along line 9—9 of FIG. 8.

As in the previously described embodiment, the carrier and shaft are joined in a unitary configuration by press-fitting the shaft into a stepped cavity 47 (FIG. 9) of the carrier. In the embodiment of FIG. 7 a stop collar 54 of the shaft is exterior of the carrier which, as shown in FIG. 9 has only a leftward protruding boss 46. With the position of the carrier fixed on the shaft 120, a thrust bearing 165 and race rings 166 between the face of collar 54 and the inward face of boss 161 and other end bearing 167 and race rings 168 fix the axial relationship of the carrier to the end bells, which is necessary for the cylinder valving and sealing arrangement of the invention.

With regard to the valving of the engine of FIG. 7, it should be understood that valve 170 of each cylinder acts not only with respect to fuel intake and exhaust outlet but also acts as the compression head for the cylinder. Therefore, valve configuration is important to the operation of the invention embodiment. The configuration of the valve itself is best perceived with respect to cylinder 154 of FIG. 8 which, as indicated by the legend and arrows of the Figure, is in open position near the end of the ignition cycle and the beginning of the exhaust cycle. Valve 170 comprises a flat face 171 of circular configuration tapering in conical fashion to match a frustro conical valve seat 172 near the outlet of the cylinder. As in the previous embodiments, a restricted port 65A of the cylinder is also conical in configuration and an outer face 79A of the valve dome is a segment of a cylinder as is the like piston dome face 79 in the previously described embodiment. Thus, when the valve is closed, as shown in FIG. 8 with respect to cylinder 152, there is concentricity between the outer valve surface and the inner surface of the surrounding manifold cylinder 140.

Returning to valve 170 of cylinder 154, it can be seen that a conical dome section 175 thereof is truncated by the outer valve surface 79A. The valve is actuated by an attached lever arm 176 fixed to a rotating valve rod 177 such that valve 170 follows an arcuate path in the cylinder when actuated. Therefore, the closed position of the valve is within the restricted port 65A which itself is a truncated cone but the cone of port 65A is off axis with respect to the axis of the cylinder to accommodate to the arcuate movement of the valve 170. Both port 65A and closure seat 172 are off-axis with respect to the cylinder.

Conventional sparkplugs may be used to ignite the fuel mixture within the cylinder and a sparkplug aperture 179 is visible in FIG. 8 for each of cylinders 152 and 153 but obscured by valve 170 for cylinder 154.

The rotation of engine carrier 130 is clockwise as viewed in FIG. 8 and it is noteworthy that the piston travel is tangent to a circle centered on the axis of the powershaft so that reaction on the face of the valve seat to thrust of the piston is additive to the inertia of the carrier so that volumetric efficiency is increased due to the design of the engine of the invention.

Figure 10:
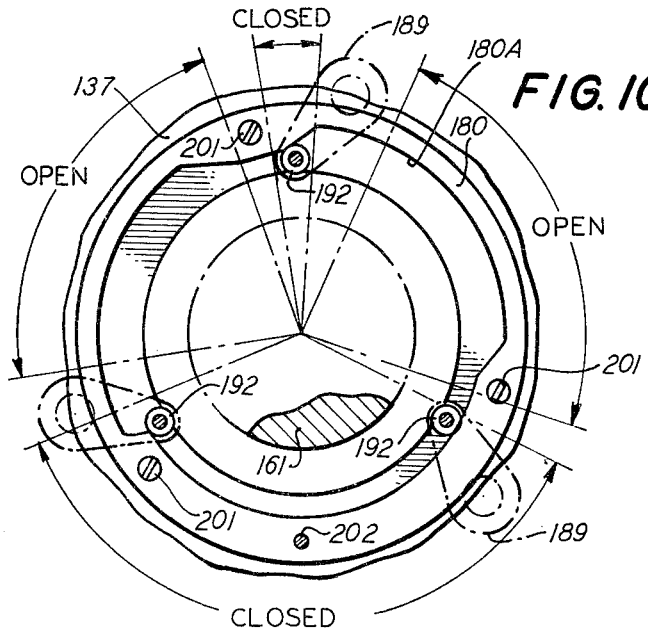
FIG. 10 is a schematic sectional view, partly broken away, of the valve can arrangement of the embodiment of FIG. 7 and taken along line 10—10 of FIG. 9.
Figure 11:
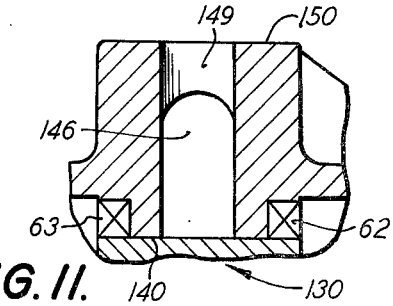
FIG. 11 is a fragmentary sectional view taken along line 11—11 of FIG. 8.
Figure 12:
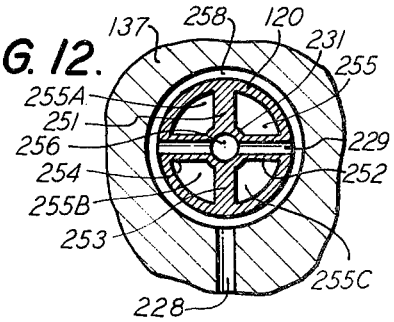
FIG. 12 is a fragmentary transverse sectional view taken along line 12—12 of FIG. 9.

The arrangement of the gears 97 and 99, which are the power transmission gears for the engine, is similar to that shown in FIG. 4 for the previously described embodiments and are likewise flexible in ratio arrangement. The valve timing is controlled by a valve cam 180 which is schematically shown in FIG. 10 with the physical position of the cam being shown in FIG. 9 along with an associated valve rod 177 and other mounting facility.

Looking at FIG. 9, valving arm 176 is seen fixed to valve rod 177 which is bearing mounted within an inner web 182 of the carrier and further supported by a bearing at the outer end of valve rod carrier boss 184. The three valves are identical in configuration and operation and a description of one suffices for the three.

A circumferential recess 185 at the end boss 184 retains a coil spring 187 whose extending arm 188 biases a valve lever 189. The valve lever is fixed to the valve rod by a pin 191. On the valve lever 189 remote from the valve rod is a projecting cam roller 192 which engages the cam surface 180A of cam 180. Spring 187 thus loads the cam roller into contact with the cam surface and, as the carrier progresses clockwise in FIG. 8 and FIG. 10, the stepped configuration of cam surface 180A urges the valve closed by means of its linkage and the spring opens the valve after the stepped portions of the cam are traversed in the rotation of the cam roller about the cam. As engine RPM increases, centrifugal force overrides the spring force to insure proper valve tracking of the cam throughout the entire range of engine operation.

The opening and closing of the valves of course, coordinated with the four-cycle operation of the combustion engine of the embodiment of FIG. 7. As can be seen from FIG. 8, the expanding gases during ignition have driven piston 155 of cylinder 154 close to bottom dead center. The restricted port 65A has started to open upon manifold chamber 145 and the exhaust gases can thus begin to escape through exhaust port 148.

The piston of chamber 152 at the same time is at top dead center with the restricted port 65B being just closed while the port 65C and valve 170 of cylinder 153 are also closed against a manifold parting gate, having just accomplished the intake cycle of the engine drawing fuel from manifold chamber 146 through intake port 149.

There are three cylinders in engine carrier 130 and the manifold 131 has peripheral porting gates 195, 196, and 197 which separate the lobe chambers 145 and 146 and also define the limits of compression-ignition relief chamber 198. The duration of the travel of the extreme aperture of restricted ports 65 A-C across the gates is, of course critical and must be carefully coordinated with the cam-operated valves. The valve cam 180 is secured to end bell 137 by a plurality of screws 201 which may reside in oversize holes in the cam. This allows small adjustments of the cam with respect to the gates of the manifold and a calibrating pin 202 is used to fix the cam once it has been adjusted.

The embodiment of FIG. 7 discloses an engine wherein there are 3 power strokes per revolution of the engine. By changing the number of manifold gates and chambers and the gear ratio of the fixed timing gear to the piston crankshaft gears, the number of power strokes may be increased. Such a change in the cycling of the carrier also necessitates a change in the ignition arrangement; however, such changes are well within the scope of the practitioners of this particular art.

While a three cylinder engine has been illustrated, a carrier with an even number or cylinders may be more easily balanced dynamically, since the travel of the pistons in each cylinder of an opposed pair would result in equal displacement of the piston from the carrier center of rotation. Obviously, the change in number of cylinders requires a like change in cam configuration, spark timing and manifold porting, in keeping with good design practice.

The ignition system shown for the embodiment of FIG. 7 is exemplary only and several other systems other than that shown may be utilized in combination with the unique features of the invention.

As is shown in FIG. 7, a sparkplug such as a plug 211 is engaged in the carrier and exposed through cavity 179 to the interior of each cylinder. A radial connector 212 extends between each spark plug and a commutator ring 215 fixed to carrier boss 46 to therewith. The commutator ring rides partially within an electrical distribution ring 216 which serves as a distributor and which is connected by a plurality of wire leads 217 through a connector 218 to the exterior of the end bell 133. Leads run from the connector to conventional ignition means such as coil, and condenser or to their electronic equivalents. The distributor rings may be compound and be both distributor and points. Other such ignition means are conventional and need not be described for the purposes of disclosing the instant invention.

While no alternator has been shown one may be fixed to accessory bell 137 as is electric starter 111. Starter 111 connects through the bell to a pinion gear 221 (see FIG. 9) meshed with a larger starter gear 222 and housed within appended bell carrying hub 139. Gear 222 is fixed to shaft 120 by a key 223 such that gear 222 rotates whenever the shaft does. Gear 221 may be linked to a starter motor (FIG. 7) through a Bendix drive or other common intermittent centrifugal connecting means. Gear 222 is placed to bar mixing of lubricating and cooling liquids. The gear acts as a centrifugal separator to preclude mixing in the gear chamber and subsequent migration of any coolant passing seals 224 and any lubricant passing seal 224A by centrifuging such bypass liquids along separated paths out a vent port 225 at the bottom of the accessory bell. The starter gear also affords a power shaft mounted disk to serve as a harmonic balancer.

The oil filter 260 is connected to a lubricating system of the engine through a spin-on bushing 226 threadably engaged with a bottom portion of end bell 137 and connecting to a lubrication channel 228 which extends upwardly in the bell to an exchange port 229 within a central spindle 231 of power shaft 120. A second filter port 233 connects the filter in conventional fashion to a duct 234 which enters the interior of the space surrounded by the manifold and more particularly connects to a sump area 235. A screen 236 across duct 234 precludes entry of large particulate matter into the filter from the sump.

As can be seen from FIGS. 7 and 9, the engine manifold extends in a cylindrical shroud 241 which encompasses the valve rod bosses of engine carrier 130. It is to the cylindrical shroud that the plurality of bolts 44 fasten the end bell 137. Suitable large O-ring seals 243 prevent oil interchange from the shrouded volume between the shroud cylinder and the end bell. Such lubricant is circulated from the sump to the filter through duct 234 and through bushing 226 into duct 228 in the bell to the exchange port 229 (see FIG. 12) of the power shaft. As can be seen from FIG. 12, power shaft 120 has a plurality of radial ribs 251, 252, 253 and 254 defining internal coolant passageways 255–225C within the shaft about the spindle section 231. An oil passage 256 extends centrally of the shaft to a manifold cavity 257. Oil passage 256 is larger in diameter than either exchange port 229 or lubrication channel 228 in the bell 137 but narrows where it meets cavity 257 in a venturi throat 256A. A distribution annulus 258 in the bell around power shaft 120 supplies lubricant from channel 228 through port 229, as the shaft rotates within the confines of the annulus. Port 229 is thus continuously supplied by the oil proceeding through the channel 228 from the filter (dotted lines 260).

Manifold cavity 257 communicates through three arcuately spaced radial openings 259 to each of a plurality of crankshaft chambers 261, the number of chambers being equal to the number of pistons, which not only communicate with manifold cavity 257 but with the cylinders 152,153 and 154 in which the pistons reciprocate.

Crankshaft chambers 261 are displaced radially from the piston carrier rotation axis and each of the radial openings 259 between the manifold cavity 257 and each chamber 261 experiences high volume lubricant exchange and air exchange across the cavity to the chambers due in part to the pumping force engendered by each piston as it in turn expells a lubricant air mixture from its cylinder to another cylinder whose piston is on an up-stroke. The flow is transmitted to the lubricant in passage 256 because the size relationship between its throat 256A and the cavity 257 creates a venturi suction on the lubricant being supplied through channel 228 such that no pump is needed to create a lubricant flow through the machine of the invention.

Naturally the flow must be continuous and return ports 264 at the end of a peripheral dogleg 265 in each chamber 261 connect to the hollow interior of the carrier shroud (FIG. 9) which in turn communicates with the sump upon which the filter draws. A portion of the lubricant discharged through the three return ports 264 showers upon the cam, gears and bearings within bell 137 prior to returning to the sump 235.

Lubricant flow is thus from the filter indicated by the broken lines 260 radially through channel 228 to exchange port 229 and through oil passage 256 to the manifold cavity 257 and then into the doglegs 265 and through return ports 264 back to sump 235.

The constant rotation of the carrier centrifugally forces lubricant into the doglegs and through return ports 264 to the sump. Thus, centrifugal force and venturi effects impel the oil. Obviously the throw of the crank arm within each chamber 261, in addition to the changing attitude of the cylinders with respect to ground, also induces transfer of the lubricant into the cylinders to lubricate the various bearings and bearing surfaces of the piston assemblies.

Power shaft 120 is also used as a conduit for coolant supply and return to the engine cylinders. As previously discussed supply line 114 extends from a conventional radiator 112 to an intake port 271 of hub 139 of the engine end bell. Similarly return line 113 extends between radiator 112 and an outlet port 272 in hub 139. An annulus 274 about the shaft 120 and in the hub connects to longitudinal internal passageways 255, 255B within shaft 120, the outer shaft wall 120A is cut away at its juncture with annulus 274 to afford an entry port to the internal passageways, as shown in FIG. 14.

Coolant flows through the internal passageways, which are shown in FIG. 14, to an exchange annulus 276, shown in FIG. 9, which connects with internal passageways 255 and 255B where the outer wall 120A is cut away for fluid communication with annulus 276. A curving passage like the passage 277 extends from annulus 276 to the cooling cavity 158 (see FIG. 8) about each cylinder. The connection of the cavity is by way of port 278 intermediate the axis of rotation of the carrier and periphery 61 thereof such that a centrifugal propulsion of the coolant from the annulus to the cooling cavity is a constant.

Return flow of coolant from cavity 158 is through a passage 279 connecting between each coolant cavity and return annulus 281 which, as shown in FIG. 9, connects with passageway 255A and its diametrically opposed passageway 255C which conduct returning coolant to a return annulus 285 in shaft hub 139 which communicates with port 272 connecting to return line 133 to radiator 112. Coolant return from cavity 158 is opposed by centrifugal force. A second "pump" stage is needed to achieve coolant circulation. The passage 279 is therefore defined by walls having a pump vane shape partly surrounding the cylinder and diminishing in concentricity with carrier rim 61 as the passage 279 approaches the carrier drive shaft. The passage affords opportunity to use the reactive force of the rotating carrier to oppose centifugal force and achieve coolant return.

Power shaft 120 thereby is utilized for both coolant and lubricant delivery systems in a unique fashion such that it may be combined with conventional engine components such as filters and radiators with minimum transition elements.

The lubricant venturi effect depends upon a free air flow. Therefore it is preferred that plug 245 be a breather cap for air exchange and it is provided with a screened port 286 shown in FIG. 9 entering the shroud cylinder.

Figure 15:
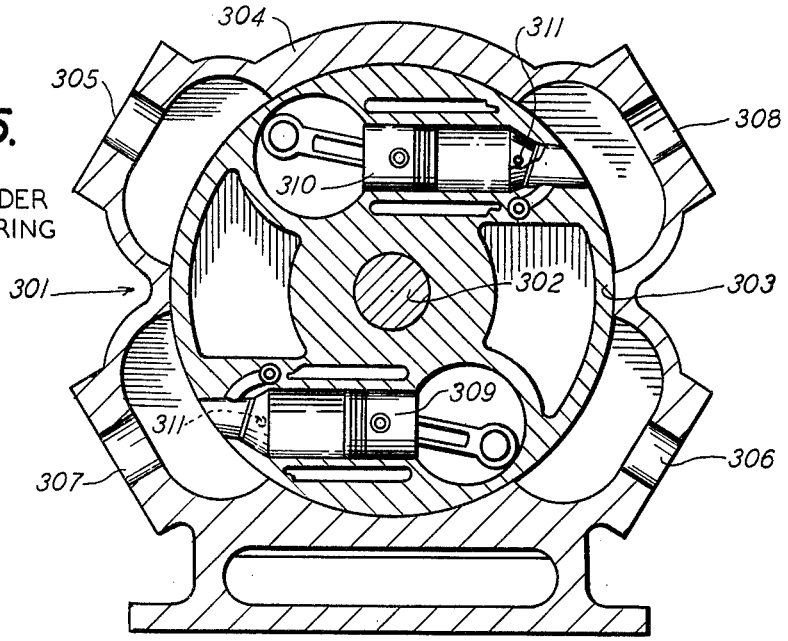
FIG. 15 is a schematic transverse section of a two cylinder engine in accordance with the invention.

The engine of the invention may be embodied in a two cylinder engine such as an engine 301 shown schematically in FIG. 15. The gear ratio between pistons and drive shaft 302 is four to one. Gearing is accomplished as set forth with respect to the description of the embodiment of FIG. 7. In accordance with that gear ratio, which results in four power pulses per rotation of a carrier 303, a manifold 304 has pairs of opposed intake ports 305, 306 and exhaust ports 307,308. Pistons 309,310 within the carrier are valved, cooled and lubricated in the same manner as the previously described embodiment of FIG. 7. However, the embodiment of FIG. 15 may be a diesel engine fueled from injectors whose discharge tips 311 are shown as circles entering the cylinders in the valve passages.

Figure 16:
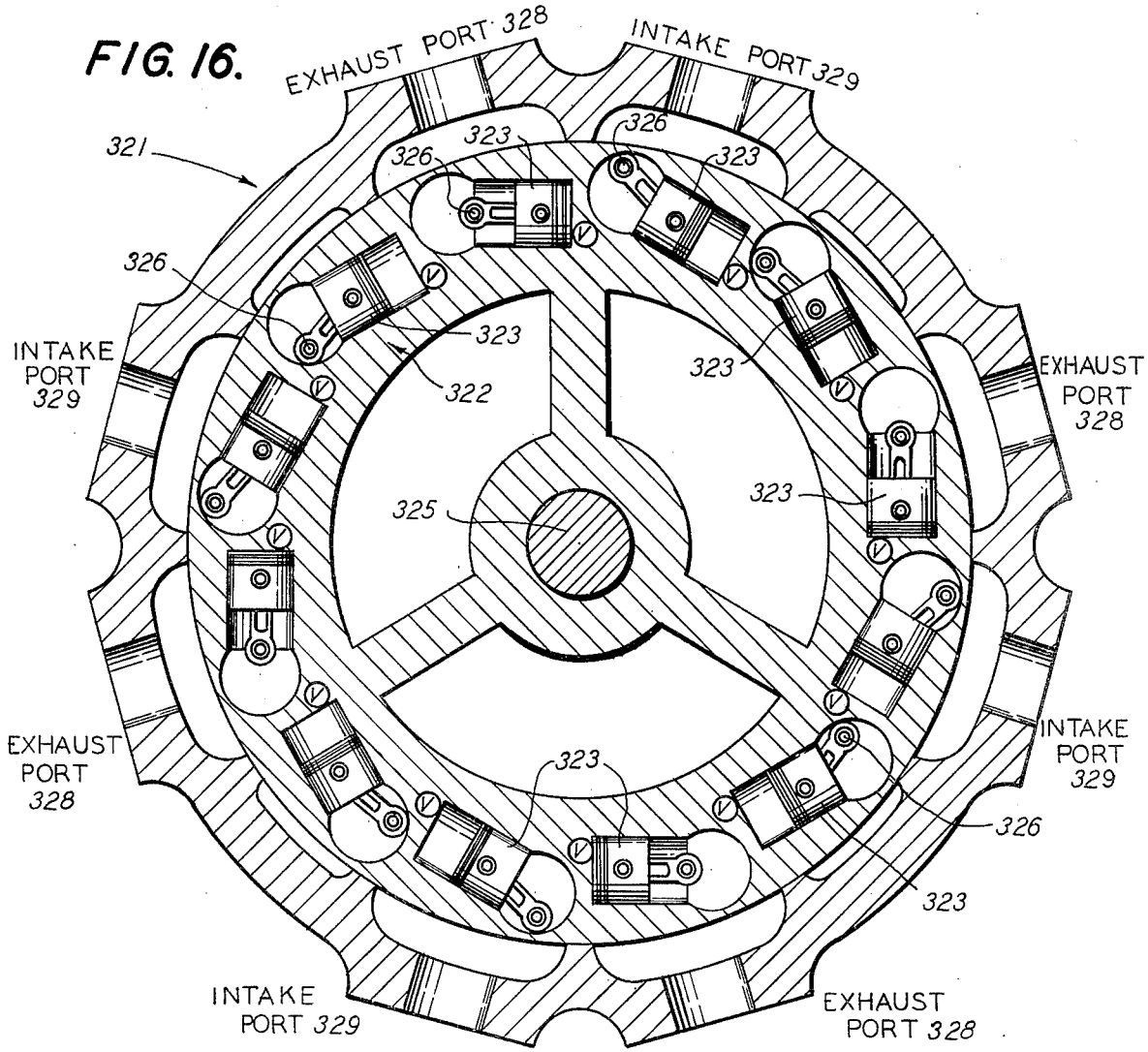
FIG. 16 is a schematic transverse section of a twelve cylinder engine in accordance with the invention.

It is also possible to use a large plurality of pistons in a single carrier in excess of those previously shown and described. In the embodiment of FIG. 16 an engine 321 has a carrier 322 in which twelve pistons 323 reciprocate. The carrier revolves around a power shaft 325 and the gearing between piston crank shafts 326 and the power shaft is such that four exhaust ports 328 and four intake ports 329 are in the manifold. Comparison of FIGS. 15 and 16 demonstrates that intake and exhaust porting is not dependent upon the number of cylinders of the carrier but rather upon the gear ratio between the power shaft and the piston crank shafts.

As an example of the efficiency of the engine set forth in this application, conventional engineering standards applied to a theoretical engine having 3 cylinders in the carrier each of 4 inch nominal bore and a 3½" stroke operating at 2,000 RPM and with a 4 to 1 gear ratio between the piston crank shafts and the power shaft gives a theoretical output of 330 braking horsepower.

The structural uniqueness of the inventive engine embodied in FIGS. 7 through 16 results in an engine of increased volumetric and mechanical efficiency. These efficiencies are achieved because of the relatively few parts making up the engine, the absence of pairs of valves for each cylinder, and the fact that valve closure at higher RPMs is aided by the centrifugal force of the rotating carrier. In addition to being more efficient the RPM range of the engine is greater than conventional engines because of this centrifugal force upon the valve closure. The closure springs on the cam arms are effective to hold the valves closed for the compression and the combustion cycles of the cylinders at low RPM. The high RPM range of the engine is made effective as in no other engine because the springs are supplemented by the effects of centrifugal force on valve closure.

Further efficiency is achieved because the cylinders are rotating about the power shaft axis and therefore the resultant of the combustion stroke, a force against the closed valve which forms the "head" of the cylinder, is a propulsion force aiding the rotation of the carrier and the propulsion of the power shaft. This resultant force in conventional reciprocating engines is wasted in engine vibration which is communicated to the rest of the engine for dissipation.

While several embodiments of the invention have been illustrated and described other modifications within the scope of the invention will occur to those skilled in this particular field. It is therefore desired that the invention be measured by the appended claims rather than by the illustrative disclosure made herein.

I claim:

1. In a fluid machine having input and output ports in a housing surrounding a work shaft and means for conducting fluid to a port, the combination comprising a carrier rotatable within the housing, an uneven plurality of cylinders in the carrier, an uneven plurality of pistons each reciprocable in a cylinder, said carrier being fixed to said work shaft, a crankshaft rotatable by each piston, a crank gear on each crankshaft, a ring gear fixed to said housing and meshing with each crank gear, a carrier passage from each cylinder to the carrier periphery, a peripheral annulus in the housing about the carrier communicating with said passages, and a plurality of gates dividing the peripheral annulus arcuately into a plurality of peripheral cavities, said input and output ports connecting each to an arcuate manifold chamber, said arcuate manifold chamber being defined by a manifold inner wall surrounding said peripheral cavities and a manifold outer wall spaced from said inner wall, said arcuate manifold chamber further having a radial web dividing said chamber into two transversely separated manifold chambers; a port between each peripheral cavity and an arcuate manifold chamber, a transverse web defining the arcuate extent of each arcuate manifold chamber; and means for impelling said carrier with respect to said housing.

* * * * *